United States Patent [19]

Nickel

[11] 4,286,573

[45] Sep. 1, 1981

[54] WATER HEATER HEAT TRAP ASSEMBLY

[75] Inventor: Herbert W. Nickel, Germantown, Wis.

[73] Assignee: A. O. Smith Corporation, Milwaukee, Wis.

[21] Appl. No.: 118,082

[22] Filed: Feb. 4, 1980

Related U.S. Application Data

[63] Continuation of Ser. No. 930,918, Aug. 4, 1978, abandoned.

[51] Int. Cl.[3] ..... F24H 1/00

[52] U.S. Cl. ..... 126/362; 137/433; 137/512; 137/515; 137/496

[58] Field of Search ..... 126/362; 137/433, 337, 137/515, 515.3, 515.5, 515.7, 512, 496, 564, 590, 592

[56] References Cited

U.S. PATENT DOCUMENTS

| | | | |
|---|---|---|---|
| 1,844,613 | 2/1932 | Thompson | 137/496 |
| 1,863,273 | 6/1932 | Hofferbert | 126/362 X |
| 1,897,492 | 2/1933 | Ledoux | 137/433 |
| 2,105,893 | 1/1938 | Salmonsen | 126/362 |
| 2,223,509 | 12/1940 | Brauer | 137/433 X |
| 3,144,904 | 8/1964 | Kahn et al. | 165/132 X |
| 3,190,284 | 6/1965 | Koepf | 137/337 X |

*Primary Examiner*—Albert W. Davis

*Attorney, Agent, or Firm*—Andrus, Sceales, Starke & Sawall

[57] ABSTRACT

A heat trap assembly to prevent heat loss in the cold water inlet and hot water outlet piping systems of hot water storage vessels. The assembly consists of a heat sealing member normally located against a seat within the piping system of the cold water inlet to close off loss of heat by thermal circulation from the hot water in the storage vessel when no cold water is flowing through the piping and into the storage vessel and a second heat sealing member located against a seat within the piping system of the hot water outlet to close off loss of heat by thermal circulation from the hot water in the storage vessel when no hot water is flowing from the vessel. The heat sealing members are moved from their respective seats when water is flowing through the piping and stops are provided which confine the longitudinal movement of the respective heat sealing members.

4 Claims, 2 Drawing Figures

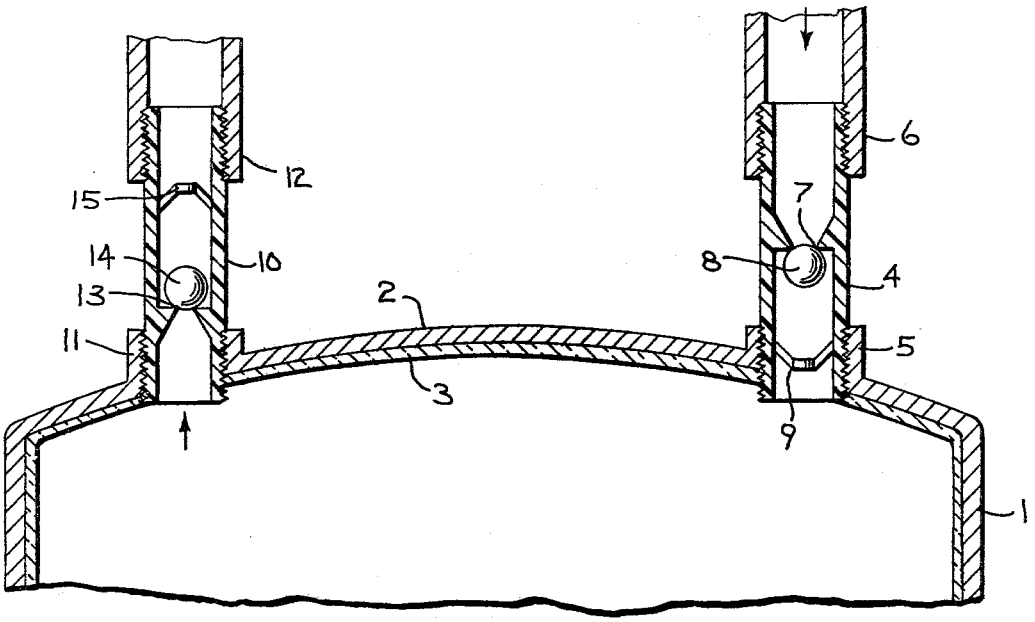
Fig. 1
Fig. 2
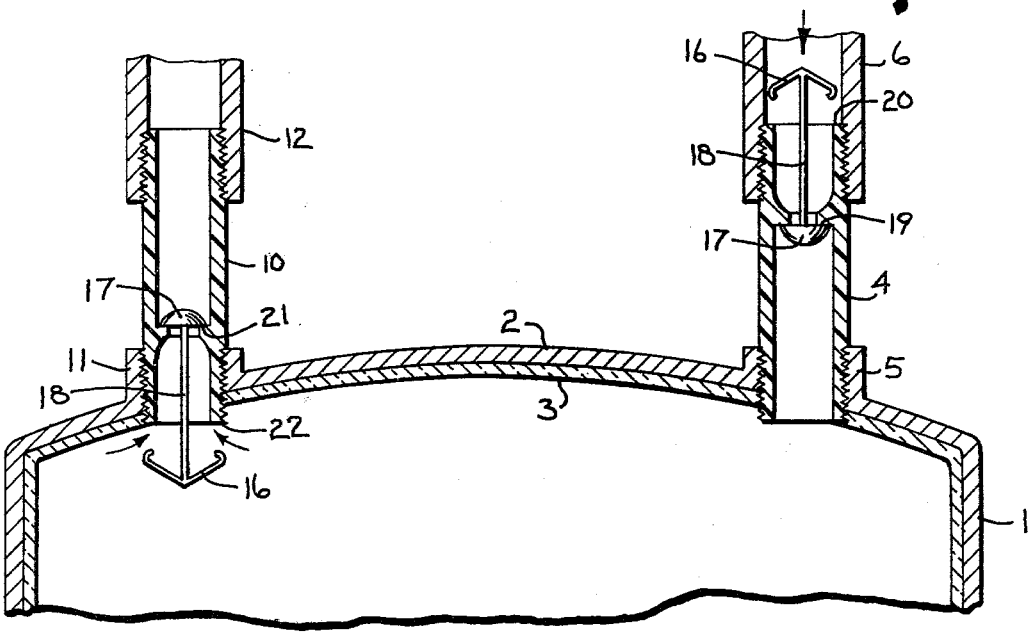

WATER HEATER HEAT TRAP ASSEMBLY

This is a continuation application of application Ser. No. 930,918, filed Aug. 4, 1978 now abandoned.

BACKGROUND OF THE INVENTION

Considerable heat is lost through the water inlet and outlet piping of a water heater. The heat is lost primarily through thermal circulation and not as a result of conduction through the piping itself. The invention provides an energy saving device comprising a heat trap assembly located in the inlet and outlet piping systems which has been found to effectively reduce standby heat losses.

SUMMARY OF THE INVENTION

The invention in general is directed to a valve seat secured inside the piping system of the cold water inlet to the hot water storage vessel and a second valve seat secured inside the piping system of the hot water outlet of the storage vessel. A sealing member which floats in the water is normally lodged on the valve seat in the cold water piping system and a sealing member which sinks in the water is normally lodges on the valve seat in the hot water piping system when no water is flowing through the respective piping system. This prevents loss of heat by thermal circulation through the piping system from the hot water stored in the vessel. When cold water is flowing to the vessel or hot water is flowing from the vessel in each case the sealing member is displaced from their respective seats to permit such flow. In each case the sealing members are retained by stops which may be a cage or a catch longitudinally spaced from the sealing members to prevent discharge of the members into the vessel in the case of the cold water or into the service piping system in the case of the hot water. The stops are of a construction to permit passage of water therethrough. Several embodiments of the invention are described but the best mode is shown and described with respect to FIG. 1.

BRIEF DESCRIPTION OF THE DRAWINGS

FIG. 1 is an enlarged sectional view with parts in elevation of the upper portion of a hot water storage vessel illustrating the invention assembly in the cold water inlet and hot water outlet; and FIG. 2 is a view similar to FIG. 1 but illustrating another embodiment of the invention.

DESCRIPTION OF THE EMBODIMENTS OF THE INVENTION

FIG. 1 illustrates a heat trap assembly to reduce heat loss from a hot water storage vessel and thereby conserve energy. As illustrated in FIG. 1 there is shown a portion of a hot water storage vessel 1 having the upper head 2 and coated on the inside with a corrosion resistant material 3.

The right portion of head 2 is provided with cold water inlet piping consisting of a nipple 4 preferably of a molded plastic material which is threaded into a nipple 5 provided as a part of the head 2. It is contemplated that nipple 4 could also be of metal and could be provided as a part of head 2 if the latter were made of metal. Molded plastic nipple 4 also could be provided as a part of vessel 1 if the latter was likewise made of plastic.

The nipples 4 and 5 are part of the cold water inlet piping system which also includes pipe 6 which is threaded onto the end of nipple 4 and connected to a source of cold water to be conveyed to vessel 1.

The inside of nipple 4 is provided with an annular valve seat 7 which is tapered inwardly toward head 2 so that valve seat 7 may be described as facing the head 2.

Valve seat 7 receives a ball 8 which may be of plastic or metal and which is of a size to close the passage through valve seat 7. Ball 8 is lighter than the cold water flowing through the piping system to vessel 1. For example, good results have been obtained with a polypropylene ball having a density of 0.95 or less so that ball 8 will readily move off from valve seat 7 when cold water is flowing through the piping system and into vessel 1 but will float in the water to valve seat 7 to seal off any conduction of heat from the hot water stored in vessel 1 through the piping system during non-flow conditions. Examples of other materials having a density of 0.95 or less which could be used in ball 8 are cellular polysulfone and polyethylene.

In order to prevent discharge of ball 8 into vessel 1 when cold water flows through pipe 6 and nipple 4 into vessel 1, the inside of nipple 4 is provided with cage or stop 9. Cage 9 is inwardly removed and longitudinally spaced from valve seat 7 and while preventing passage of ball 8, the cage construction permits flow of cold water to vessel 1.

The left portion of head 2 is provided with a hot water outlet consisting of a nipple 10, also preferably of a molded plastic material, which is threaded into a nipple 11 provided as a part of head 2. As with the cold water inlet, it is contemplated that nipple 4 could be of metal and provided as part of head 2 if the head is made of metal. Molded plastic nipple 11 also could be provided as part of vessel 1 if the latter were likewise made of plastic or like materials. The nipples 10 and 11 are part of the piping system which also includes the pipe 12 which is threaded onto the end of nipple 11 and connected to the hot water service station.

The inside of nipple 10 is provided with an annular valve seat 13 which is tapered outwardly from head 2 so that valve seat 13 may be described as facing outwardly from head 2. Valve seat 13 receives a ball 14 which may be of plastic or metal and which is of a size to close the passage through valve seat 13. Ball 14 is required to be heavier than the hot water in nipple 10 so that ball 14 will sink and close valve seat 13 when no flow of hot water is occurring through the piping system from vessel 1. For example, good results have been obtained with a polysulfone ball having a density of 1.10 or above so that the ball will readily move off from valve seat 10 when hot water is being discharged through the piping from vessel 1 but will sink in the water to valve seat 10 to seal off any conduction of heat from the hot water stored in vessel 1 through the piping system during non-flow conditions. Examples of other materials having a density of 1.10 or above which may be used in ball 14 are filled polyethylene and thermosetting plastic of epoxy and polyesters.

In order to prevent discharge of ball 14 through the piping system when the hot water is flowing, the inside of nipple 10 is provided with a cage or stop 15. Cage 15 is outwardly removed and longitudinally spaced from valve seat 10 and while preventing passage of ball 14, the cage construction permits flow of hot water from vessel 1.

FIG. 2 illustrates a second embodiment of a heat trap device to reduce heat loss from a hot water storage vessel and thereby conserve energy. This embodiment again illustrates nipple 5 formed as part of head 2, and the nipple 4 which is threaded at the inner end into nipple 5 and at the outer end into pipe 6. Cold water flows through the inlet piping system provided by pipe 6 and nipple 4 and into vessel 1.

At the left portion of vessel 1 and head 2, as in the first embodiment, the construction includes nipple 11 formed as part of head 2, and the nipple 10 which is threaded at the inner end into nipple 11 and at the outer end into pipe 12. Hot water flows from vessel 1 through the outlet piping system provided by nipple 10 and pipe 12.

However, in this embodiment the cold water piping system is provided with a heat trap which consists of a stop or catch 16 which is secured in longitudinally spaced relation to a sealing member 17 by a stiff member such as a rod 18. This construction provides catch 16 and member 17 as a single valve unit.

In the cold water inlet when no water is flowing into vessel 1, the sealing member 17 which is lighter than the cold water flowing in the piping system floats the unit upwardly under no flow conditions to lodge against the annular valve seat 19 provided inside of nipple 4 and thereby block off seat 19 to prevent loss of heat from the stored hot water. Under flow conditions sealing member 17 is dislodged from valve seat 19 so that cold water can flow through the seat to vessel 1. Catch 16 secured to the outer end of rod 18 is of a construction to permit flow of cold water therethrough and has a diameter to engage the outer end 20 of nipple 4 to limit longitudinal movement of sealing member 17 from valve seat 19 through rod 18 and rod 18 in turn prevents discharge of sealing member 17 into vessel 1.

In the hot water outlet the single valve unit is reversed. In this case the unit is heavier than the hot water so that under no flow conditions sealing member 17 lodges against valve seat 21 to block off passage of heat through the piping system from the stored hot water in the vessel. Under this condition the lower end portion of rod 18 and stop or catch 16 is located inside vessel 1. Upon hot water flowing from vessel 1, the sealing member 17 is lifted from valve seat 21 to permit passage of the hot water and catch 16 is of a diameter to engage the inner annular end 22 of nipple 10 to limit movement of sealing member 17 from valve seat 21 and retain it within the outlet piping system through rod 18 while being of a construction to permit flow of hot water therethrough.

As in the first embodiment, catch 16, sealing member 17 and rod 18 holding them together should be buoyant to float in the water. The catch 16, sealing member 17 and rod 18 used in the cold water inlet preferably are of a plastic having a density of 0.95 or less so that the unit will float under nonflow conditions to lodge on seat 19 and seal off valve seat 19 against loss of heat from the stored water. However, the unit also may be of metal or a combination of metal or plastic having a density of 0.95 or less so that it has a buoyancy to float in the cold water.

Likewise the sealing member 17 used in the hot water outlet is preferably of a plastic material as is catch 16 and rod 18, and has a density of 1.10 or above so that the unit will sink in the hot water to lodge sealing member 17 on valve seat 21. However, metal or a combination of metal and plastic may be used if the unit is provided with a density of 1.10 or above so that it will sink in the hot water.

The ball check valve arrangement as illustrated in FIG. 1 has been reduced to practice as the best mode of the invention and the results indicate that 20% less energy was consumed over constructions previously used without devices to minimize or stop thermal circulation from the stored heated water.

The invention provides an efficient heat trap to reduce heat loss from hot water stored in a vessel under no flow conditions and thereby conserve energy.

Various modes of carrying out the invention are contemplated as being within the scope of the following claims particularly pointing out and distinctly claiming the subject matter which is regarded as the invention.

I claim:

1. A heat trap assembly preventing heat loss through thermal circulation in the piping systems connected to a hot water storage vessel, which comprises a valve seat secured inside that portion of the piping system of the cold water inlet located on the outside of the vessel, a second valve seat secured inside that portion of the piping system of the hot water outlet located on the outside of the vessel, first stop means permitting passage of water therethrough disposed within the piping system of the cold water inlet longitudinally inwardly of the valve seat, and second stop means disposed in the piping system of the hot water outlet longitudinally outwardly of the valve seat, a first sealing member located in the cold water inlet and having a density of 0.95 or less and adapted to float in the water upwardly in engagement with the valve seat when no water is flowing inwardly through the inlet to thereby prevent loss of heat from the stored water outwardly through the cold water inlet, and a second sealing member located in the hot water outlet and having a density of 1.10 or above and adapted to sink in the water into engagement with the valve seat in the hot water outlet when no hot water is being drawn off from the vessel to thereby prevent loss of heat from the stored water outwardly through the hot water outlet, and the stop means preventing discharge of the sealing means from the inlet and outlet passages when water is flowing therethrough.

2. The heat trap assembly of claim 1 in which that portion of the assembly located outside the storage vessel is a normally insulating nipple.

3. The heat trap assembly of claim 1 in which the sealing member in the cold water inlet is a ball of polypropylene and the sealing member in the hot water outlet is a ball of polysulfone.

4. The heat trap assembly of claim 1 and the stop means and sealing members being a single unit joined together generally by a stiff member in spaced relation with respect to each other.

* * * * *